US010670299B2

(12) United States Patent
Balakrishna et al.

(10) Patent No.: US 10,670,299 B2
(45) Date of Patent: Jun. 2, 2020

(54) SIDE-MOUNTED ELECTRIC HEATER

(71) Applicant: TRANE INTERNATIONAL INC., Davidson, NC (US)

(72) Inventors: Abhijith Balakrishna, Bangalore (IN); Wilson Samuel Jesudason Lawrence, Bangalore (IN); Lane A. Liudahl, Holmen, WI (US); Jason Harpst, Clarksville, TN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 495 days.

(21) Appl. No.: 15/481,867

(22) Filed: Apr. 7, 2017

(65) Prior Publication Data

US 2018/0292105 A1 Oct. 11, 2018

(51) Int. Cl.

| | |
|---|---|
| ***F24F 1/009*** | (2019.01) |
| ***F24F 1/0373*** | (2019.01) |
| ***F24F 13/20*** | (2006.01) |
| ***F24H 3/02*** | (2006.01) |
| *F24F 13/32* | (2006.01) |
| *F25B 13/00* | (2006.01) |
| *F24F 1/0093* | (2019.01) |

(52) U.S. Cl.

CPC ..... *F24F 13/20* (2013.01); *F24H 3/022* (2013.01); *F24F 1/0093* (2019.02); *F24F 13/32* (2013.01); *F25B 13/00* (2013.01)

(58) Field of Classification Search

CPC ..... F24F 1/009–0093; F24F 1/0373–0375; H05B 2203/022–023

See application file for complete search history.

(56) References Cited

U.S. PATENT DOCUMENTS 1,981,916 A * 11/1934 Huntley ..... F24F 6/12 219/473
3,111,573 A * 11/1963 Crowe ..... F24H 3/0411 392/363
3,157,390 A * 11/1964 Douglas ..... D06F 58/26 392/310
3,467,176 A * 9/1969 Truhan ..... F24F 3/12 165/97
3,991,819 A * 11/1976 Clark ..... F24F 1/02 165/59
5,110,418 A * 5/1992 Garrison ..... B01D 3/02 137/392
5,987,908 A * 11/1999 Wetzel ..... F24F 1/027 62/259.1
6,595,011 B1 * 7/2003 Forgy ..... F24F 5/0035 62/305

(Continued)

*Primary Examiner* — Michael A Laflame, Jr.
(74) *Attorney, Agent, or Firm* — Hamre, Schumann, Mueller & Larson, P.C.

(57) ABSTRACT

An HVACR fan and heater assembly accounts for the cyclonic flow produced by centrifugal blowers by placing a heater vertically and biased towards a side of a fan cabinet in order to increase and balance airflow through the heater, eliminating hot spots and fire risk and improving heater efficiency. A blockoff in the fan cabinet forces airflow within the cabinet to move through the heater. The positioning of the heater may vary depending on the direction of rotation of the centrifugal blower. The fan and heater assembly may further include baffles to direct the airflow from the centrifugal blower.

8 Claims, 8 Drawing Sheets

(56) References Cited

U.S. PATENT DOCUMENTS

| | | | | |
|---|---|---|---|---|
| 8,129,662 | B2 * | 3/2012 | Cameron | F24D 15/02 126/110 R |
| 10,252,213 | B2 * | 4/2019 | Uramoto | F24F 1/0375 |
| 2004/0198214 | A1 * | 10/2004 | Karidis | F24F 7/10 454/186 |
| 2007/0039462 | A1 * | 2/2007 | Helt | B03C 3/12 95/6 |
| 2010/0170281 | A1 * | 7/2010 | Kamino | A61L 9/22 62/271 |
| 2014/0326428 | A1 * | 11/2014 | Meirav | F24F 3/1603 165/11.1 |
| 2015/0241072 | A1 * | 8/2015 | Kim | F24F 3/14 236/44 C |

* cited by examiner

SIDE-MOUNTED ELECTRIC HEATER

FIELD

An HVACR fan cabinet and heater assembly for use in commercial packaged HVACR products.

BACKGROUND

Commercial packaged HVACR systems such as rooftop units for servicing large buildings such as office buildings, multi-tenant dwellings, or warehouses, use centrifugal blowers such as plenum fans to drive airflow through the systems. Near a centrifugal blower such as a plenum fan, the airflow may be a horizontal tornado, with a rotation determined by the direction in which the fan is spinning. This can result in uneven pressurization of the fan cabinet and result in uneven flow through heating elements attached to the fan cabinets which are used to heat buildings. This uneven flow may require a larger cabinet to allow airflows to normalize before the airflow passes through heating elements used to heat the air then supplied to a building by the HVACR system, causing the HVACR system to be larger than necessary and limiting the building which can be serviced by the HVACR system.

SUMMARY

An HVACR fan and heating assembly including a fan cabinet with a heater mounted vertically and horizontally biased towards one of the side walls of the fan cabinet. The cabinet contains a centrifugal blower and has at least a blower-side wall, a solid blockoff opposite the blower-side wall, a first side wall that is to the left of the centrifugal blower from the perspective of the blockoff, a second side wall to the right of the centrifugal blower from the perspective of the blockoff, and a heater mount on the solid block-off that is biased towards the first side wall or the second side wall based on the direction of rotation of the centrifugal blower.

In an embodiment, the blockoff may be a smooth planar surface without flanges or protrusions into the cabinet.

In an embodiment, the centrifugal blower may be a plenum fan or a housed fan.

In an embodiment, the heater mount may be aligned vertically, such that the height of the mounted heater is greater than its width.

In an embodiment, the biasing based on the direction of rotation of the centrifugal blower may be towards the second side wall where the centrifugal blower rotates clockwise with respect to the blockoff, or may be on a towards the first side wall where the blower rotates counter-clockwise with respect to the blockoff.

In an embodiment, the HVACR cabinet may further include at least a second centrifugal blower, and one or more baffles disposed within the cabinet.

In an embodiment, the baffles may be disposed between a centrifugal blower and a second centrifugal blower.

By accounting for the cyclonic flow of air leaving a centrifugal blower, the airflow exiting a fan cabinet through a heater can be made more even. Improving the evenness of airflow through the heater improves the safety and efficiency of the heater by improving heat transfer from the heater to the airflow and preventing the formation of hot spots on the heater, which accelerate heater wear and present a fire risk. Additionally, ways to improve the evenness of airflow without requiring a lengthening of the fan cabinet facilitate integration of such fan cabinets and fan and heater assemblies into packaged HVACR solutions such as rooftop units.

DETAILED DESCRIPTION

In an HVACR fan and heater assembly, the heater may be placed biased to one side of a fan cabinet and mounted vertically such that the height of the heater is greater than its width, receiving airflow more evenly across the entire heater, and improving the safety and efficiency of the unit. The fan and heater assembly may be incorporated into a larger HVACR unit, such as a rooftop system serving a structure, such as an office building, apartment complex, or warehouse.

Figure 1:
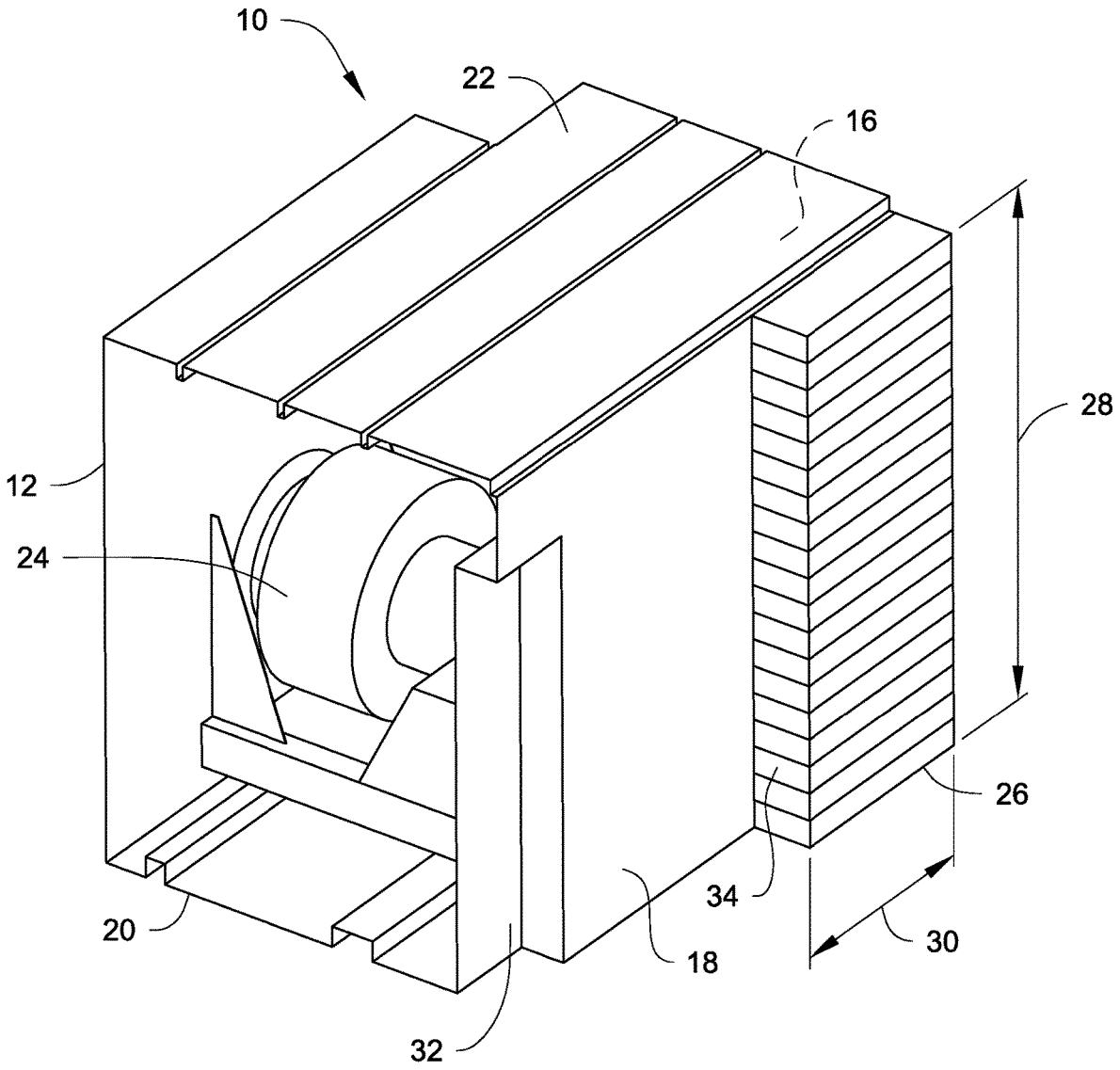
FIG. 1 is a diagram displaying an example embodiment of an HVACR cabinet with a heater mounting.

FIG. 1 depicts an embodiment including a fan cabinet 10, which has blower-side wall 12, side walls 14 and 16, and a blockoff 18. The fan cabinet 10 has a bottom 20 and a top 22. The fan cabinet contains a centrifugal blower 24. A heater 26 is connected to the fan cabinet on the side of the blockoff 18, with the blockoff 18 running at least from a side of the heater 26 to one of the side walls 14 or 16. In some embodiments, the blockoff 18 may also run above or below the heater between the top or bottom of the heater and the top 22 or bottom 20 of the fan cabinet 10. In some embodiments, the blockoff may be on either side of the heater, extending from the sides of the heater to both of the side walls 14 and 16.

The fan cabinet 10 may be defined by the blower-side wall 12, the side walls 14 and 16, the bottom 20, the top 22 and the blockoff 18. The blower-side wall 12 may include an inlet through which air may enter the centrifugal blower 24. The centrifugal blower 24 is located primarily within the fan cabinet 10, though some of it may extend past the blower-side wall 12 in some embodiments. First side wall 14 is, from the perspective of the blockoff 18, to the left of the centrifugal blower 24. Second side wall 16 is, from the perspective of the blockoff 18, to the right of the centrifugal blower 24. Heater 26 is mounted on the fan cabinet, at an opening in the blockoff 18.

The centrifugal blower 24 may be, for example, a plenum fan or a housed fan. Centrifugal blower 24 takes in air through an inlet in blower-side wall 12 and forces the air into the fan cabinet 10. The centrifugal blower 24 may rotate in a clockwise or counter-clockwise direction, that direction defined by the rotation of the centrifugal blower with respect to the blockoff 18. In the embodiment depicted in FIG. 1, the centrifugal blower 24 rotates in a clockwise direction. The centrifugal blower 24 brings air through an inlet in the blower-side wall 12 axially, and within the fan cabinet 10 distributes the air radially. In some embodiments, multiple centrifugal blowers may be used within a single fan cabinet.

In the fan cabinet 10, opposite the blower-side wall 12, there is a blockoff 18 and a heater 26. The blockoff 18 prevents escape of the air within the fan cabinet 10, forcing air to travel through the heater 26 in order to escape the fan cabinet 10. A side of the blockoff 18 faces the inside of the fan cabinet 10. The side of the blockoff 18 facing the inside of the fan cabinet may be a smooth planar surface free of flanges or protrusions which may affect airflow. In some embodiments, there may be a recess 32 in the side of the blockoff facing the outside of the fan cabinet, where, for example, a control panel for the HVACR unit which includes the fan cabinet may be located.

Heater 26 is a heater, such as an electric heater, warming the airflow that passes through as the airflow exits the fan cabinet 10. The heater has a height 28 and a width 30. In some embodiments, the heater may be oriented vertically. In the vertical orientation, the long side of the heater runs in a direction from the bottom 20 of fan cabinet 10 towards the top 22 of fan cabinet 10. In the vertical orientation, the major axis of the heater is in the direction from the bottom 20 of the fan cabinet towards the top 22 of the fan cabinet. In the vertical orientation, the height 28 of the heater, running in the direction from the bottom of the fan cabinet 20 towards the top of the cabinet 22 is greater than the width of the cabinet running the direction from the first side wall 14 towards the second side wall 16. In an embodiment, the height 28 of the heater 26 matches the distance between the top 22 and bottom 20 of the fan cabinet 10. In an embodiment, the height 28 of the heater 26 may be less than a height of the fan cabinet 10, with the height of the fan cabinet 10 measured as distance between the top 22 and bottom 20 of the fan cabinet 10. In embodiments where the height 28 of the heater 26 is less than the distance between the top 22 and the bottom 20 of the fan cabinet 10, portions of the blockoff 18 cover the areas above the heater, up to the top 22 of the cabinet and below the heater down to the bottom 20 of the cabinet. In embodiments where the height 28 of the heater 26 is less than the distance between the top 22 and the bottom 20 of the fan cabinet 10, and wherein the top of the heater 26 is not flush with the top 22 of the fan cabinet 10, a baffle may be placed at or near the top 22 of the fan cabinet 10 to deflect airflow into an intake of the heater 26.

In some embodiments, the heater 26 may be oriented horizontally, with its major axis running between the first side wall 14 and the second side wall 16. When oriented horizontally, the width of the heater 30 is greater than the height of the heater 28. In these embodiments, the width of the heater 30 may be less than the distance from the first side wall 14 to the second side wall 16 and the height of the heater 28 may be less than the distance from the bottom 20 of the cabinet 10 to the top 22 of the cabinet 10.

The heater 26 is positioned with a horizontal bias towards one of the side walls 14 or 16, placing the heater closer to one side wall than it is to the other and offset from a center-line of the fan cabinet. In the embodiment depicted in FIG. 1, the position of the heater is biased towards the second side wall 16 and is further from the first side wall 14. The biasing of the heater towards the first side wall 14 or the second side wall 16 may be such that the width of the heater 30 does not at any point overlap with the width of the centrifugal blower 24 when viewed from the perspective of the blockoff 18. The heater may, in some embodiments, be mounted such that a side of the heater is flush with the side wall it is biased towards, as depicted in FIG. 1, where the side of the heater 26 is flush with the second side wall 16. The heater may be mounted to the fan cabinet 10 by a heater mounting 34, which includes an opening in the fan cabinet 10 and connection points for mounting the heater 26 to the fan cabinet 10, such as tabs, flanges, holes for fasteners such as screws and/or other such mechanical connections, with the opening 34 matching the size of the inlet to the heater.

In some embodiments, the position of the heater 26 may be biased vertically. The heater 26 may be biased towards the top 22 of the cabinet 10 relative to the centrifugal blower 24. In some embodiments, the heater 26 may be biased such that a top of the heater 24 is flush with the top 22 of the cabinet 10. In these embodiments, the blockoff 18 extends from the first side wall 14 to the second side wall 16 below the heater 26, and in embodiments where the heater 26 is not flush with the top 22 of the cabinet 10, extend from the first side wall 14 to the second side wall 16 above the heater 26, and extend from a side of the heater 26 to the first side wall 14 and/or the second side wall 16, and extend from the first side wall 14 to the second side wall 16 below the heater 26. In some embodiments, the biasing of the heater towards the top 22 of fan cabinet 10 may be such that the height of the heater 28 does not at any point overlap with the height of the centrifugal blower 24 when viewed from the perspective of the blockoff 18.

Figure 2:
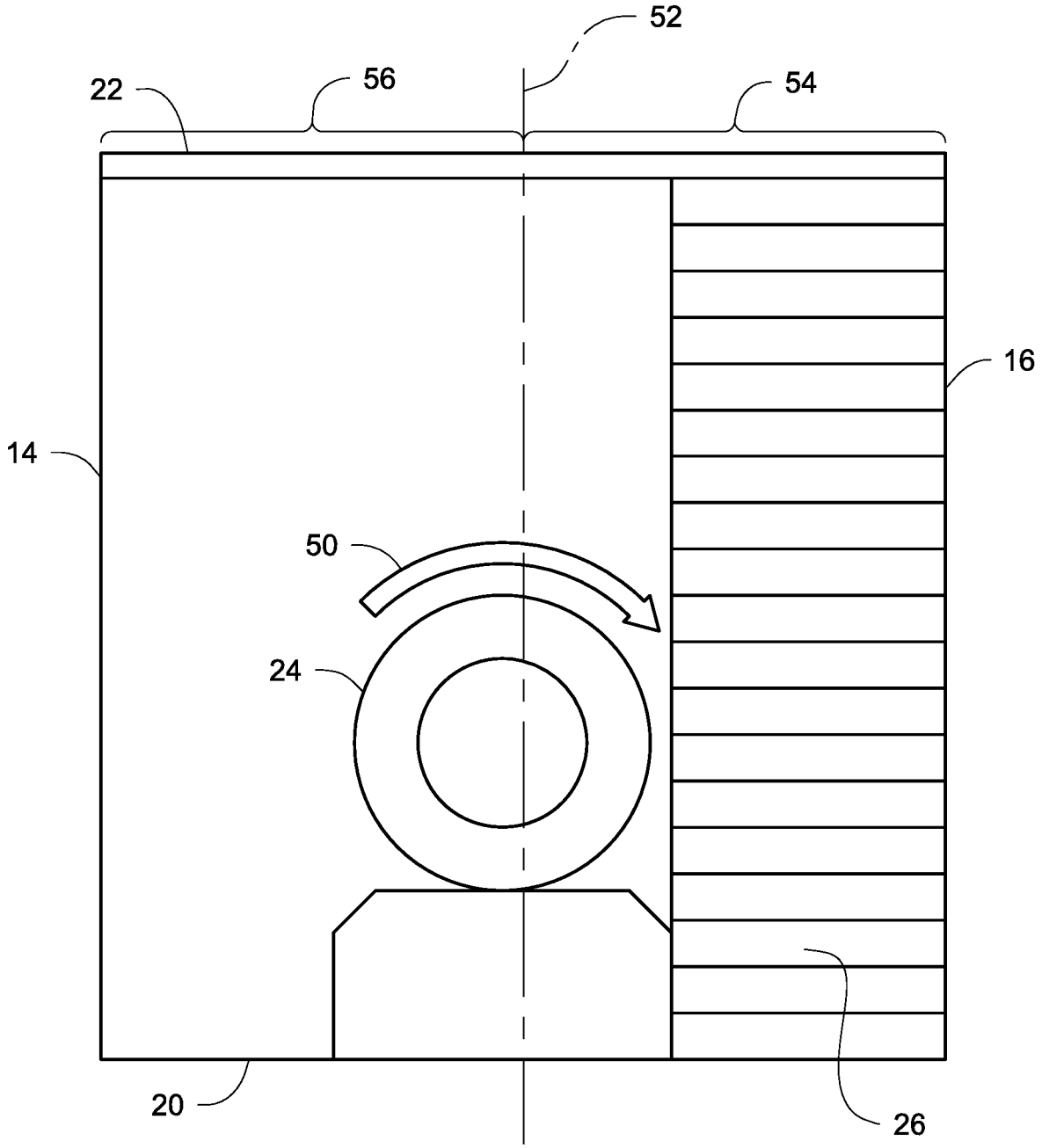
FIG. 2 is a diagram of the embodiment of FIG. 1 providing a view from the perspective of a blockoff side of a fan cabinet.

FIG. 2 is a view of the embodiment of FIG. 1 from the perspective of the blockoff 18. The centrifugal blower 24 is offset towards one side of the cabinet from the center line 52. The centrifugal blower includes a fan, which has a direction of rotation 50. In the embodiment depicted in FIG. 2, the direction of rotation 50 is clockwise with respect to the position of the blockoff 18, but in other embodiments the direction of rotation 50 may be counter-clockwise. The side towards which the position of the heater is biased may be based on the direction of rotation 50 of the fan from the perspective of the blockoff 18 and the heater 26. The biasing of the heater position may be such that the centrifugal blower 24 is completely viewable from the perspective of the inside of blockoff 18, and not obstructed by any portion of the width 30 of heater 26. In embodiments, such as that shown in FIG. 2, where the centrifugal blower 24 or each of multiple centrifugal blowers rotate clockwise with respect to the blockoff 18 and heater 26, the heater may be biased towards the second side wall 16, placed within a region 54 extending towards the second side wall 16 from the center line of the cabinet 52. In some embodiments, for example where there is more than one centrifugal blower 24, the position of the heater 26 may be such that the width 30 of heater 26 overlaps with at the width of at least one of the centrifugal blowers, and at least one of the centrifugal blowers is not completely viewable from the perspective of the inside of blockoff 18. In embodiments where the centrifugal blower 24 or each of multiple centrifugal blowers rotate counter-clockwise, the position of the heater 26 may be biased towards first side wall 14, within a region 56 extending towards the first side wall 14 from the center line of the cabinet 52. Region 54 and region 56 may be defined with respect to the centrifugal blower 24. From the perspective of the blockoff 18, the rotation of the centrifugal blower 24 in embodiments where there is one centrifugal blower 24 within the fan cabinet 10 may define a twelve-to-six orientation proceeding from the top center of the centrifugal blower 24, clockwise around to the bottom center of the centrifugal blower 24, with everything to this side from the center of the centrifugal blower to the second side wall defined as region 54. This may also define a six-to-twelve orientation proceeding from the bottom center of the centrifugal blower 24 and rotating clockwise towards the top center of the centrifugal blower 24, with everything on this side from the center of the centrifugal blower 24 to the first side wall 14 defined as region 56.

Figure 3:
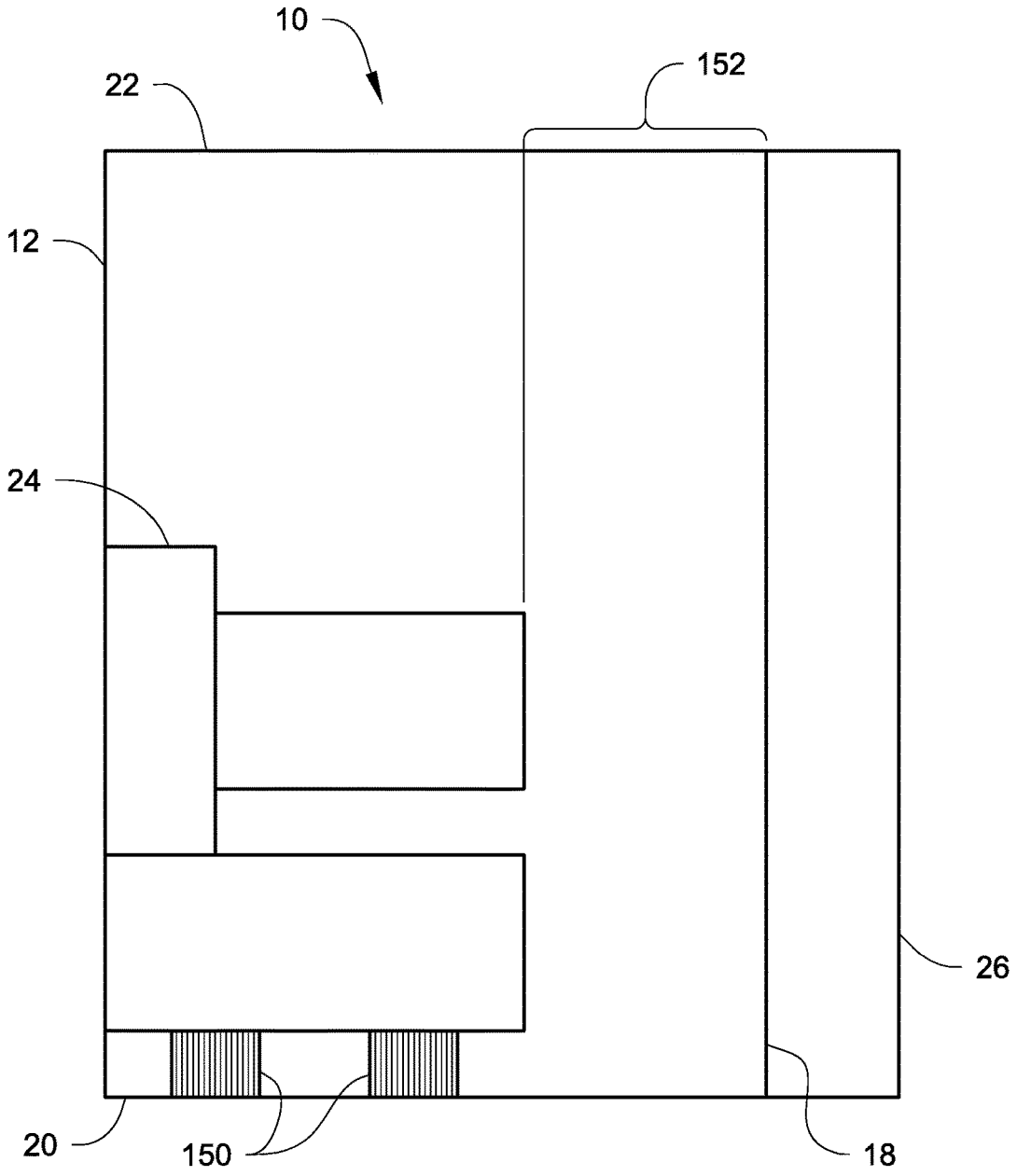
FIG. 3 is a view of the embodiment of FIG. 1 from the perspective of a side wall of a fan cabinet.

FIG. 3 is a view of the embodiment of FIG. 1 from the perspective of a first side wall 14. In this embodiment, centrifugal blower 24 distributes air through fan cabinet 10. The centrifugal blower 24 may be mounted to the bottom 20 of the fan cabinet 10 using blower mounts 150. In some embodiments, there may be raised portions of the bottom 20 of fan cabinet 10, on which blower mounts 150 may be located. Space 152 is the area between the end of the centrifugal blower closest to the blockoff 18 and the blockoff 18. Space 152 may be shortened in fan cabinets and systems where the heater 26 is oriented with its major axis or long direction running vertically from the bottom 20 of the fan cabinet 10 towards the top 22 of the fan cabinet 10, and where the heater 26 is biased towards a first side wall 14 or a second side wall 16 based on the direction of rotation 50 of a centrifugal blower 24. Shortening space 152 provides a more compact design which is more space-efficient compared to other orientations and positions which may require space 152 to be longer to allow airflow to even out before entering a heater 26.

Figure 4:
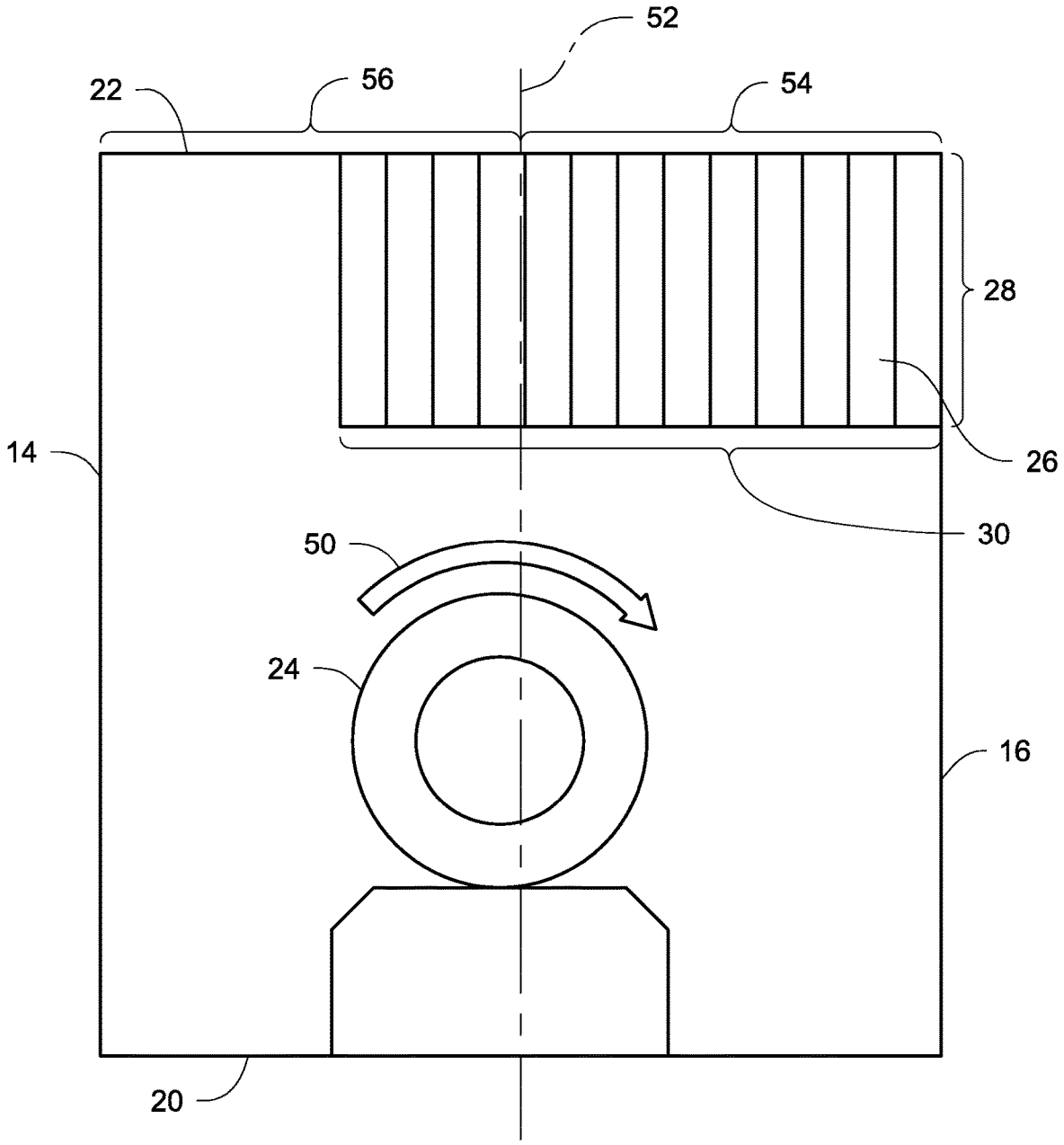
FIG. 4 is a diagram of an embodiment with a horizontally-mounted heater, from the perspective of a blockoff side of the fan cabinet.

FIG. 4 is an embodiment where the heater 26 is mounted horizontally, and biased vertically towards a top 22 of the fan cabinet 10 and biased horizontally towards a second side wall 16, viewed from the perspective of the blockoff 18. In this embodiment, the major axis of the heater runs between the first side wall 14 and the second side wall 16. The height of the heater 28 is less than the width of the heater 30. In this embodiment, a side of the heater 26 is flush with the second side wall 16, and the top of the heater 26 is flush with the top 22 of the cabinet 10. In some embodiments, the heater may be mounted below the top 22 of the cabinet and/or with some of the blockoff 18 between each side of the heater and the first side wall 14 and second side wall 16. In embodiments where the top of the heater 26 is not flush with the top 22 of the fan cabinet 10, a baffle may be positioned at or near the top 22 of the fan cabinet 10 to direct airflow downwards from the top 22 of the cabinet towards an inlet to the heater 26. In some embodiments, the width 30 of the heater 26 may cross the center line 52 of the cabinet 10. In this example embodiment, the horizontal biasing of the heater is such that a greater portion of the width 30 of the heater 26 is on one side of the center line 52 of the cabinet 10. In some embodiments, the heater 26 may be entirely on one side of the center line, for example in region 56 towards the second side wall 16 from the center-line 52. The horizontal biasing may be based on a direction of rotation 50 for the centrifugal blower 24, with the heater biased towards the second side wall 16 a clockwise direction of rotation 50, and biased towards a first side wall 14 when the direction of rotation 50 is counter-clockwise. The vertical biasing of the position of the heater 26 may be such that the heater 26 is above the centrifugal blower 24 when viewed from the perspective of the blockoff 18.

Figure 5:
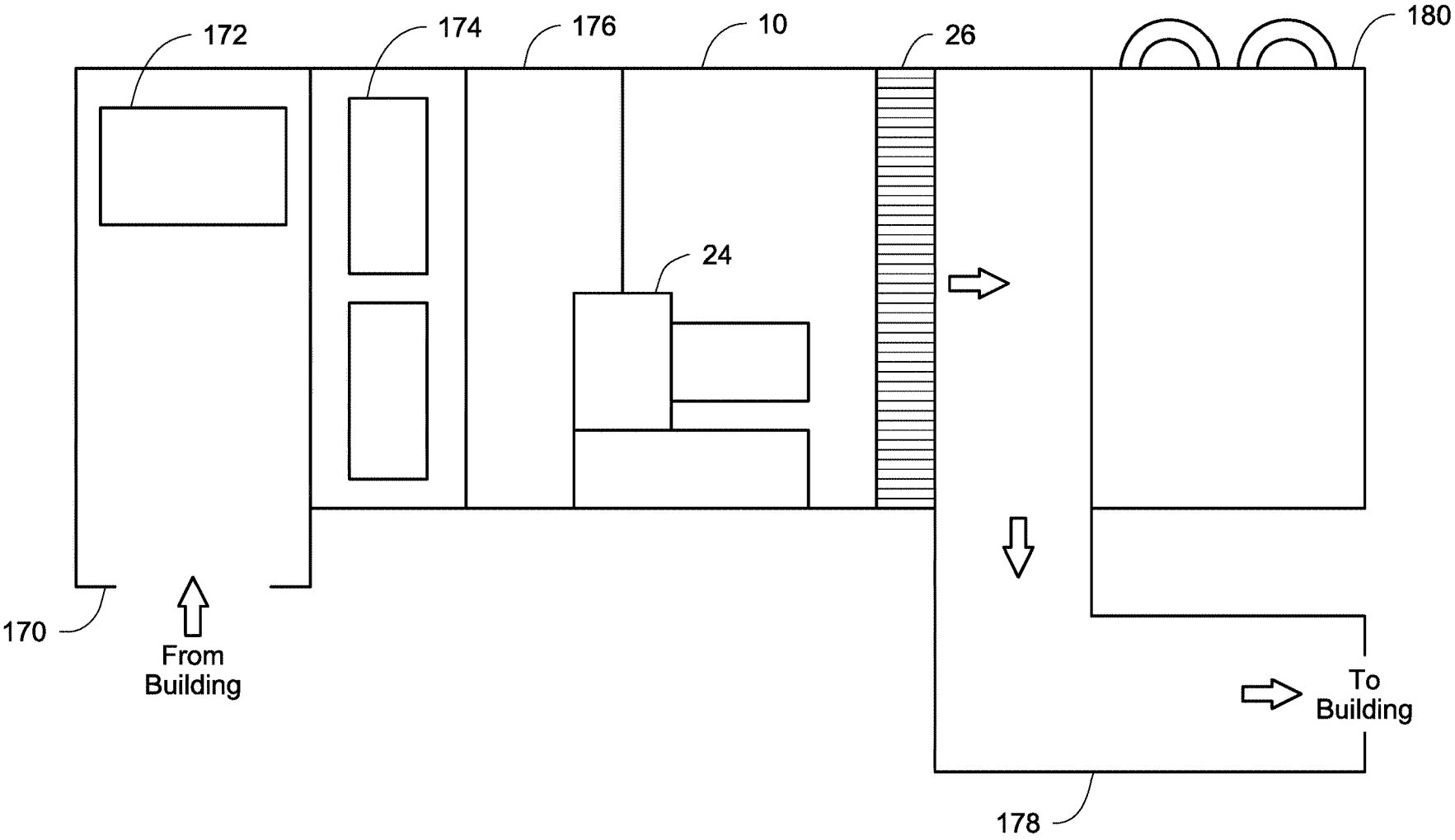
FIG. 5 is a diagram of an embodiment integrated into an HVACR system and the airflow through the system

FIG. 5 is an embodiment of a rooftop HVACR system. The system may be located on the roof of a building to provide HVACR to the building. The system includes return air return air inlet 170, through which air from the building enters the system, and in some embodiments may include outside air intake 172, one or more openings through which air from outside the building may enter the HVACR system. The air entering the system through the return air inlet 170 and outside air intake 172 may then enter a filter unit 174. The filter unit 174 is a cabinet which directs air to and through one or more filters. Following the filter unit there may be a chamber 176 prior to the fan cabinet 10. Air is drawn into the fan cabinet 10 by centrifugal blower 24, which then expels the air into fan cabinet 10. Air circulates through fan cabinet 10 and exits fan cabinet 10 through heater 26. Heater 26 is oriented vertically, with a major axis running between the bottom 20 and the top 22 of the fan cabinet 10. Air exits heater 26 and travels into and through supply outlet 178. Supply outlet 178 is one or more ducts or vents connecting the HVACR system to the HVACR distribution ducts or vents of the building. The rooftop HVACR system may additionally include condensers 180.

Figure 6:
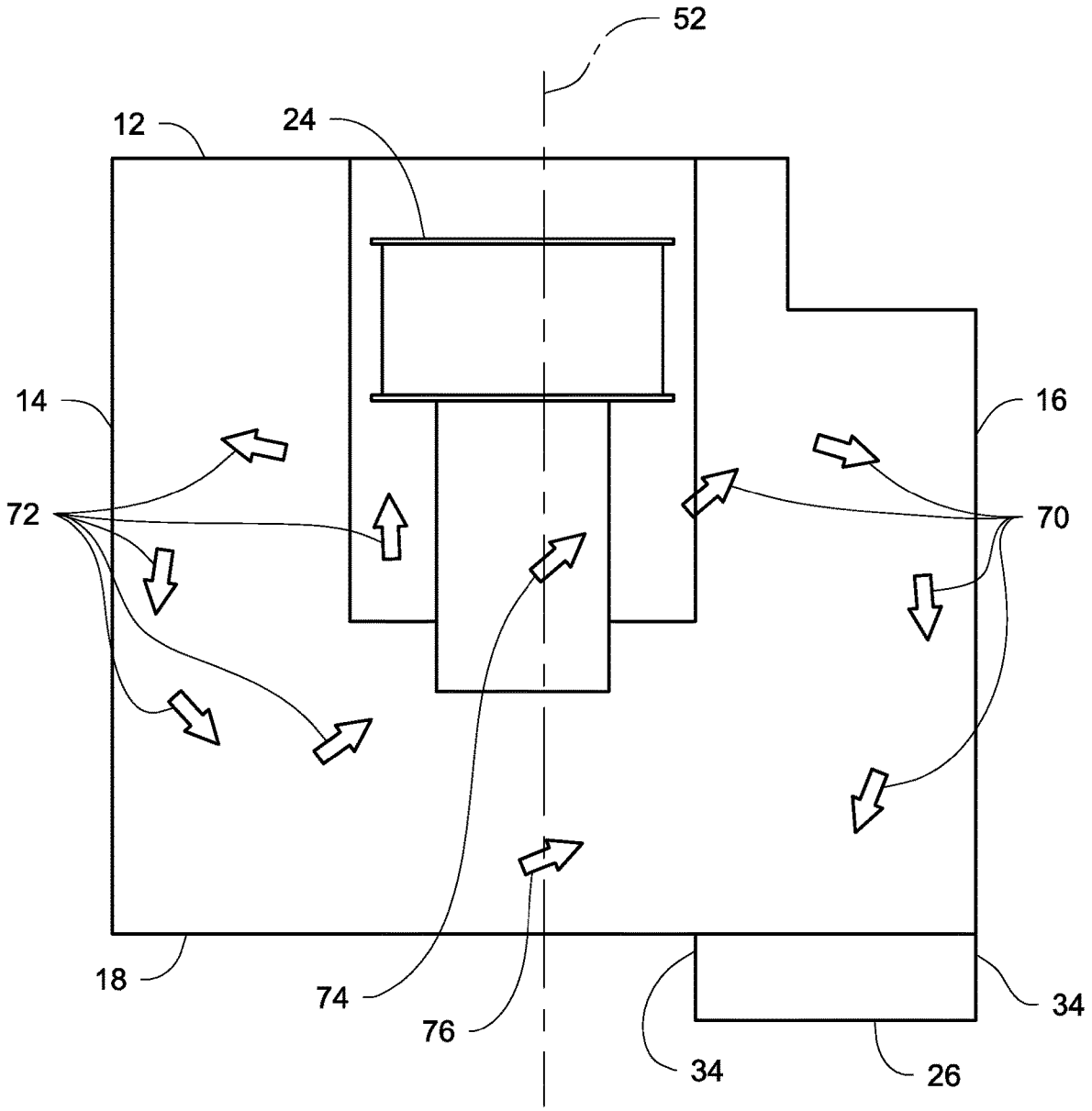
FIG. 6 is a top-down view of the embodiment of FIG. 1, showing airflows during operation.

FIG. 6 is a top-down perspective of the embodiment of FIG. 1 and shows the airflow through the embodiment during operation. The centrifugal blower 24 draws air into the fan cabinet and the air circulates within the blower-side wall 12, the side walls 14 and 16 and the blockoff 18, ultimately entering and passing through the heater 26 on leaving the fan cabinet. The airflow passing through the fan cabinet may continue through a rooftop HVACR unit and be directed to and distributed through a building such as a commercial office building or a warehouse.

The airflow 70 exiting the centrifugal blower 24 in region 54 between the center line 52 of the fan cabinet 10 and the second side wall 16 flows towards the second side wall 16 and the blower-side wall 12. The airflow 70 traveling along the blower-side wall 12 is deflected towards the second side wall 16. The airflow 70 travels along and may be deflected by the second side wall 16 towards heater 26, through which it leaves fan cabinet 10.

The airflow 72 exiting the centrifugal blower 24 in region 56 between the center line 52 of the fan cabinet 10 and the first side wall 14 flows towards the blower-side wall 12 and is deflected by the blower-side wall 12 towards the first side wall 14. The airflow 72 continues along and may be deflected by the first side wall 14 towards the blockoff 18.

Air from airflow 72 may pass over or under the centrifugal blower 24 following airflow 74 or may pass between the end of the centrifugal blower 24 and the blockoff 18 following airflow 76. Airflows 74 and 76 may converge with airflow 70 in region 54 of the fan cabinet 10 and follow the path of airflow 70 towards the blower-side wall 12, then towards the second side wall 16, and to and through the heater 26.

Figure 7:
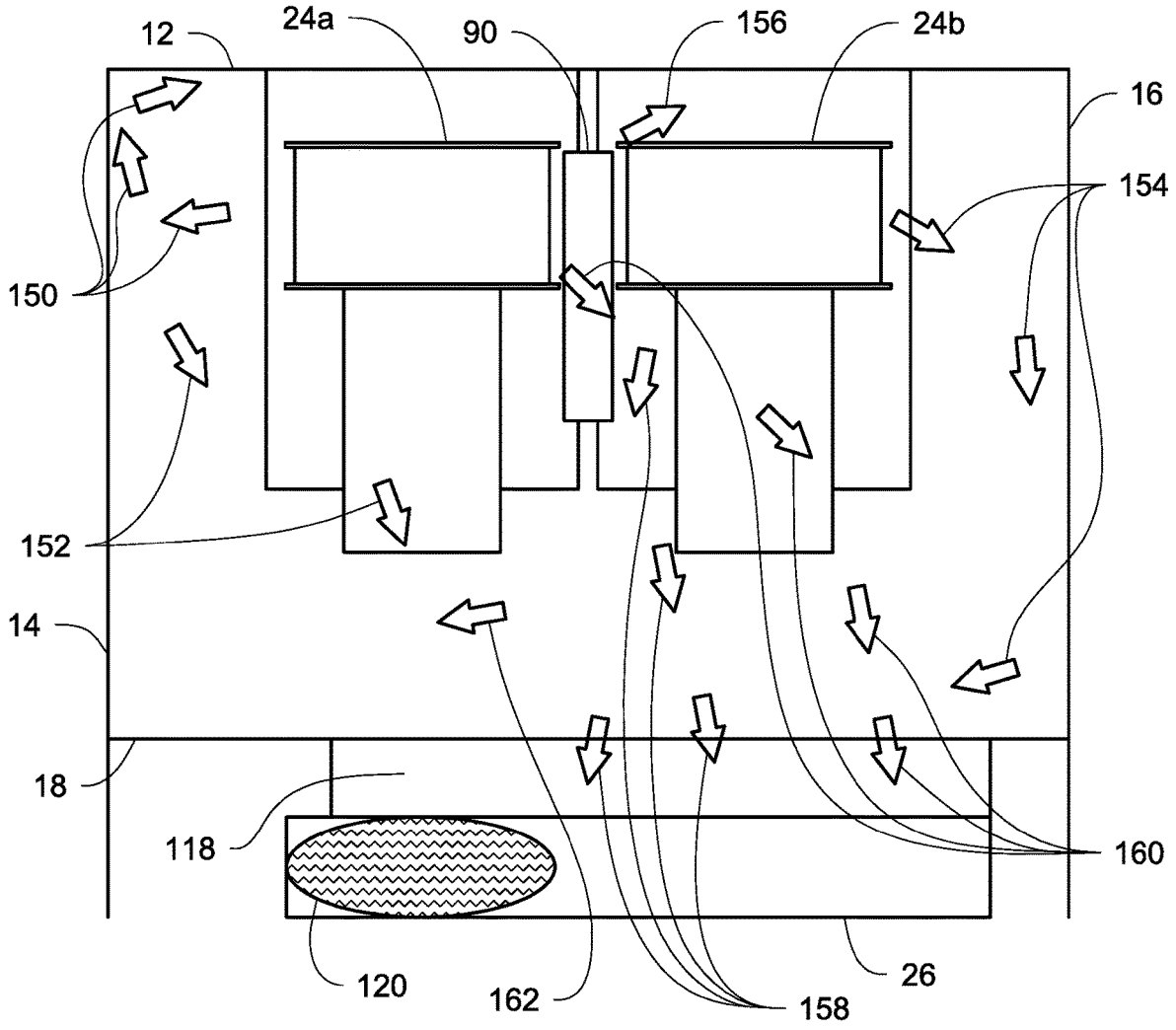
FIG. 7 is a top-down view of a fan cabinet featuring two centrifugal blowers and including a heater mounting according to the heater mounting of FIG. 4, and showing airflows during operation.

FIG. 7 shows airflow through an embodiment where two centrifugal blowers **24*a* and 24*b* are located within the cabinet and where the heater mounting is oriented horizontally and biased horizontally and vertically according to the heater mounting of FIG. 4. In embodiments where there are two centrifugal blowers 24*a* and 24*b*, a baffle 90 may be disposed between the two blowers, in the form of a vertical plate. Air leaving centrifugal blower 24*a* on the side of the first side wall 14 forms airflow 150, which deflects off of first side wall 14, with most of the airflow 150 traveling towards blower-side wall 12. Some of airflow 150 is deflected towards the blockoff 18, forming airflow 152 towards heater 26. Airflow 154 leaving blower 24*b* on the side of the second side wall 16 deflects off of the second side wall 16 and continues parallel to the second side wall 16 towards the blockoff 18. Airflow 154 is deflected by the blockoff 18 towards first side wall 14, forming a horizontal airflow 162. Airflow 160 leaving the blower 24*a* on the second side wall 16 side of the blower travels towards and through the heater 26, with some horizontal deflection occurring where the airflow contacts horizontal airflow 162. Airflow 156 leaves the blower 24***a* on the first side wall 14 side of the blower, and travels towards the blower-side wall 12, then along the blower-side wall 12 towards the second side wall 16, where it may join airflow 154. Airflows 152, 158, 160, and portions of airflow 154 move to and through the heater 26, where heat is transferred to the air. These airflows may leave a low-airflow region 118 entering the heater, resulting in a hot spot 120 forming where there is reduced heat transfer from the heater 26 to the airflows. Where such a hot spot 120 is located at a specific end of the heater 26, the hot spot 120 may then be mitigated by reducing the width 30 of the heater 26 or adjusting the horizontal or vertical biasing of the position of the heater 26.

Figure 8:
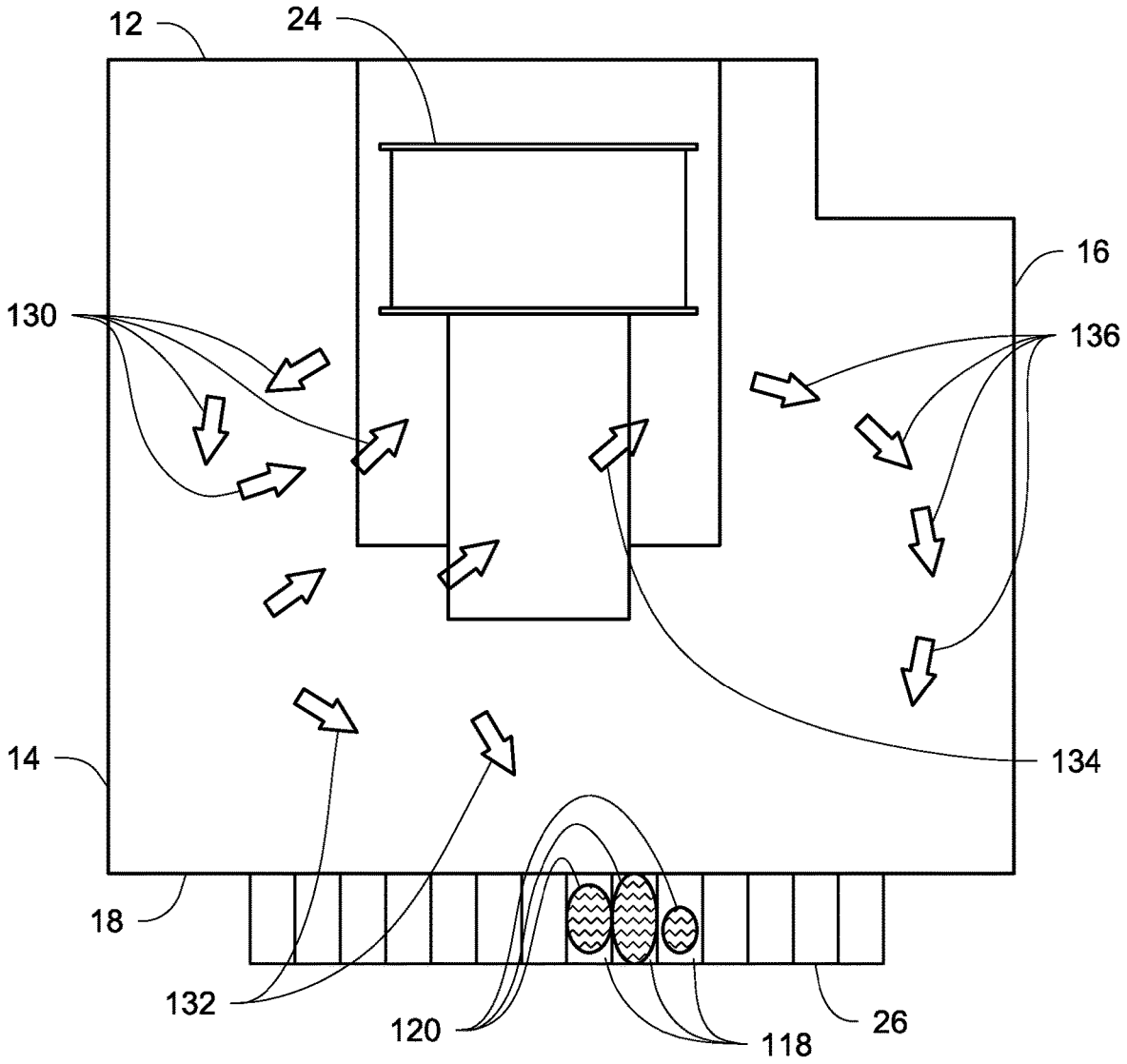
Fig. 8 Prior Art
FIG. 8 is a diagram of airflow through an embodiment of the prior art.

FIG. 8 shows the airflow in a prior art configuration of fan cabinet and heater. In the prior art embodiment, the heater 26 is mounted such that the major axis of the heater 26 is horizontal, in a direction running from the first side wall 14 towards the second side wall 16. In this horizontal orientation, the width of the mounted heater 26 is greater than its height. The heater 26 may cross the centerline of the fan cabinet and/or the center line of the centrifugal blower 24. In the prior art, airflow 130 of air leaving the centrifugal blower 24 on the side of the first side wall 14 circulates between the centrifugal blower 24 and the first side wall 14. A portion of airflow 130 moves to and through the horizontally-mounted heater 26 as airflow 132, while other air from airflow 130 along with air exiting the top of centrifugal blower 24 travels as airflow 134. Airflow 134 may join airflow 136, which may also include air exiting the centrifugal blower 24 on the side of second side wall 16, and airflow 136 circulates along second side wall 16 and towards and through heater 26. The airflows 132 and 136 to and through the heater 26 result in a significant number of low-airflow regions 118, reducing heater efficiency and resulting in the formation of dangerous hot spots 120. Note that the prior art embodiment of FIG. 8, with a centrally positioned, horizontally-oriented heater produces significantly more low-flow regions 118 and corresponding hot spots 120 compared to the example embodiments.

Aspects:

It is to be appreciated that any one of aspects 1-8 may be combined with any of aspects 9-16 or 17-20, and that any of aspects 9-16 may be combined with any of aspects 17-20.

Aspect 1. An HVACR fan and heater assembly, comprising:

a centrifugal blower, a fan cabinet, comprising a blower-side wall, a blockoff opposite the blower-side wall a first side wall located to the left of the centrifugal blower from the perspective of the blockoff and a second side wall located to the right of the centrifugal blower from the perspective of the blockoff, a heater, and wherein the blockoff extends from the outside of the heater to at least one of the first side wall or the second side wall, wherein a position of the heater is horizontally biased towards either the first side wall or the second side wall.

Aspect 2. The HVACR fan and heater assembly according to aspect 1, wherein the centrifugal blower is a plenum fan.

Aspect 3. The HVACR fan and heater assembly according to aspect 1-2, wherein the heater is mounted such that it has a width that is greater than its height and the position of the heater is vertically biased towards a top of the fan cabinet.

Aspect 4. The HVACR fan and heater assembly according to any of aspects 1-3, wherein the position of the heater is such that a side of the heater is flush with the first side wall or the second side wall.

Aspect 5. The HVACR fan and heater assembly according to any of aspects 1-4, wherein the centrifugal blower rotates clockwise with respect to the blockoff and the position of the heater is biased towards the second side wall.

Aspect 6. The HVACR fan and heater assembly according to any of aspects 1-4, wherein the centrifugal blower rotates counter-clockwise with respect to the blockoff and the position of the heater is biased towards the first side wall.

Aspect 7. The HVACR fan and heater assembly of any of aspects 1-6, further comprising a second centrifugal blower.

Aspect 8. The HVACR fan and heater assembly according to aspect 7 further comprising a baffle disposed between the centrifugal blower and the second centrifugal blower.

Aspect 9. An HVACR fan cabinet comprising:

a blower-side wall, a blockoff, opposite the blower-side wall, a first side wall joined to a left edge of the blower-side wall from the perspective of the blockoff a second side wall joined to a right edge of the blower-side wall from the perspective of the blockoff, and a heater mounting, wherein the position of the heater mounting is biased towards one of the first side wall or the second side wall, wherein the blockoff extends from the heater mounting to at least one of the first side wall or the second side wall.

Aspect 10. The HVACR fan cabinet according to aspect 9, wherein the heater mounting is oriented such that the width of the heater mounting is greater than the height of the heater mounting and a vertical position of the heater mounting is biased towards a top of the fan cabinet.

Aspect 11. The HVACR fan cabinet according to any of aspects 9-10, wherein the position of the heater mounting is biased such that one side of the heater mounting is flush with one of the first side wall or the second side wall.

Aspect 12. The HVACR fan cabinet according to any of aspects 9-11, further comprising a heater connected to the heater mounting.

Aspect 13. The HVACR fan cabinet according to any of aspects 9-12, wherein the blower-side wall comprises an inlet.

Aspect 14. The HVACR fan cabinet according to aspect 13, further comprising a centrifugal blower mounted within the cabinet and wherein the centrifugal blower interfaces with the inlet of the blower-side wall.

Aspect 15. The HVACR fan cabinet according aspect 14, wherein the centrifugal blower rotates clockwise with respect to the blockoff and the position of the heater mounting is biased towards the second side wall.

Aspect 16. The HVACR fan cabinet according to aspect 14, wherein the centrifugal blower rotates counter-clockwise with respect to the blockoff and the position of the heater mounting is biased towards the first side wall.

Aspect 17. An HVACR system, comprising:

a return air inlet, a filter, a centrifugal blower, a fan cabinet comprising a first side wall, a second side wall, a blower-side wall, a top, a bottom, and a blockoff, a heater, mounted on the blockoff, with a horizontal position biased towards one of the first side wall or the second side wall, and a supply outlet.

Aspect 18 The HVACR system of aspect 17, wherein the heater is mounted on the blockoff with a vertical position biased towards the top of the fan cabinet and oriented such that a width of the heater is greater than a height of the heater.

Aspect 19. The HVACR system according to any of aspects 17-18, wherein the return air inlet receives air from a building and the supply outlet provides air to the building.

Aspect 20. The HVACR system of any of aspects 17-19, the heater is flush with the first side wall or the second side wall of the fan cabinet.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. An HVACR fan and heater assembly, comprising:

a centrifugal blower, a fan cabinet, comprising a blower-side wall, a blockoff opposite the blower-side wall, a first side wall located to the left of the centrifugal blower from the perspective of the blockoff, and a second side wall located to the right of the centrifugal blower from the perspective of the blockoff, a heater, and wherein the blockoff extends from an outside of the heater to at least one of the first side wall or the second side wall, wherein a position of the heater is horizontally biased towards either the first side wall or the second side wall.

2. The HVACR fan and heater assembly of claim 1, wherein the centrifugal blower is a plenum fan.

3. The HVACR fan and heater assembly of claim 1, wherein the heater is mounted such that it has a width that is greater than its height and the position of the heater is vertically biased towards a top of the fan cabinet.

4. The HVACR fan and heater assembly of claim 1, wherein the position of the heater is such that a side of the heater is flush with the first side wall or the second side wall.

5. The HVACR fan and heater assembly of claim 1, wherein the centrifugal blower rotates clockwise with respect to the blockoff and the position of the heater is biased towards the second side wall.

6. The HVACR fan and heater assembly of claim 1, wherein the centrifugal blower rotates counter-clockwise with respect to the blockoff and the position of the heater is biased towards the first side wall.

7. The HVACR fan and heater assembly of claim 1, further comprising a second centrifugal blower.

8. The HVACR fan and heater assembly of claim 7, further comprising a baffle disposed between the centrifugal blower and the second centrifugal blower.

* * * * *